US007767031B2

(12) United States Patent
Thomas et al.

(10) Patent No.: US 7,767,031 B2
(45) Date of Patent: Aug. 3, 2010

(54) DIESEL PARTICULATE FILTER CLEANING APPARATUS AND METHOD

(75) Inventors: James A. Thomas, Spencerville, IN (US); Karl Reith, Auburn, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 213 days.

(21) Appl. No.: 11/837,698

(22) Filed: Aug. 13, 2007

(65) Prior Publication Data

US 2009/0044375 A1 Feb. 19, 2009

(51) Int. Cl.
*B08B 9/00* (2006.01)

(52) U.S. Cl. ..... 134/166 R; 55/301

(58) Field of Classification Search ..... None
See application file for complete search history.

(56) References Cited

U.S. PATENT DOCUMENTS

| | | | | | |
|---|---|---|---|---|---|
| 3,867,291 | A | | 2/1975 | Schmidt, Jr. et al. | |
| 3,923,653 | A | * | 12/1975 | Lavins, Jr. | 210/769 |
| 4,482,367 | A | * | 11/1984 | Howeth | 55/304 |
| 4,808,234 | A | * | 2/1989 | McKay et al. | 134/21 |
| 4,842,624 | A | | 6/1989 | Barton | |
| 5,156,660 | A | * | 10/1992 | Wilson | 55/291 |
| 5,223,005 | A | | 6/1993 | Avondoglio | |
| 5,253,476 | A | | 10/1993 | Levendis et al. | |
| 5,426,936 | A | | 6/1995 | Levendis et al. | |
| 5,616,171 | A | | 4/1997 | Barris et al. | |
| 5,725,618 | A | | 3/1998 | Shimoda et al. | |
| 5,915,439 | A | | 6/1999 | Zaiser | |
| 2002/0026682 | A1 | * | 3/2002 | Yamaguchi | 15/302 |
| 2004/0103788 | A1 | | 6/2004 | Streichsbier et al. | |
| 2006/0162562 | A1 | * | 7/2006 | Simpson, Jr. | 95/278 |
| 2007/0157809 | A1 | | 7/2007 | Ehlers | |

* cited by examiner

*Primary Examiner*—Michael Kornakov
*Assistant Examiner*—Ryan Coleman
(74) *Attorney, Agent, or Firm*—Jeffrey P. Calfa; Mark C. Bach

(57) ABSTRACT

A diesel particulate filter of a motor vehicle is cleaned of diesel particulate material like ash and possibly soot, typically using equipment already available in a service shop following the method and diesel particulate filter cleaning apparatus of the invention. The diesel particulate filter cleaning apparatus has an air chamber that is coupled to a vibrator and is attached to the diesel particulate filter. The vibrator vibrates the air chamber and the diesel particulate filter to dislodge the diesel particulate material. Air is introduced into the air chamber and into the diesel particulate filter to further remove the diesel particulate material from the diesel particulate filter.

11 Claims, 1 Drawing Sheet

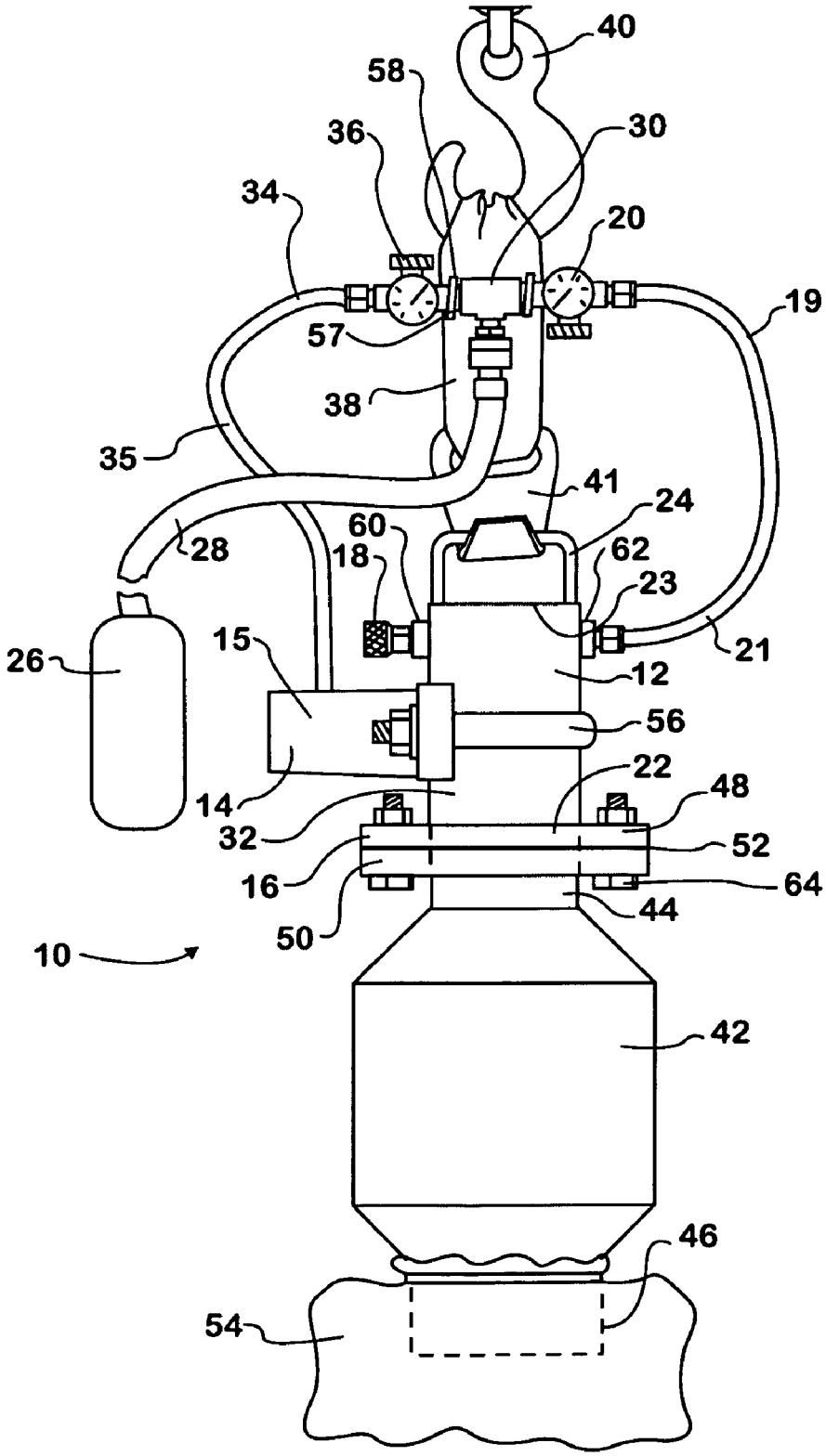
FIGURE

DIESEL PARTICULATE FILTER CLEANING APPARATUS AND METHOD

BACKGROUND OF THE INVENTION

1. Field of the Invention

The present invention relates to a method and apparatus for cleaning a diesel particulate filter for a motor vehicle.

2. Description of the Prior Art

Diesel engines are efficient, durable and economical. Diesel exhaust, however, can harm both the environment and people. To reduce this harm governments, such as the United States and the European Union, have proposed stricter diesel exhaust emission regulations. These environmental regulations require diesel engines to nearly meet the same pollution emission standards as gasoline engines.

One part of diesel exhaust includes diesel particulate material. Diesel particulate material is mainly carbon particles or soot. One way to remove soot from diesel exhaust is with diesel traps. The most widely used diesel trap is a diesel particulate filter which nearly completely filters the soot without hindering exhaust flow. As a layer of soot collects on the surfaces of the inlet channels of the filter, the lower permeability of the soot layer causes a pressure drop in the filter and a gradual rise in the back pressure of the filter against the engine. This phenomenon causes the engine to work harder, thus decreasing engine operating efficiency. Eventually, the pressure drop in the filter and decreased engine efficiency becomes unacceptable, and the filter must either be replaced or the accumulated diesel soot must be cleaned out.

The filter is cleaned of accumulated diesel soot by burning-off or oxidation of the diesel soot to carbon dioxide which is known as regeneration. Regeneration of an existing filter is superior to filter replacement, because no interruption for service is necessary.

In addition to capturing carbon soot, the filter also traps ash particles, such as metal oxides, that are carried by the exhaust gas. These particles are not combustible and, therefore, are not removed during regeneration. The filter must therefore be cleaned or discarded when the ash particles in the filter build up to high levels.

Cleaning ash from a diesel particulate filter is not easily accomplished with typical maintenance shop equipment. The use of shop air to blow out the ash particles does not lend itself to containment of the ash particles. The use of a wet/dry vacuum tool has limited effectiveness on smaller and deeply embedded particles. The use of water or solvents can be detrimental to the substrate and/or washcoat.

One method exposes the filter to excessive handling which increases the potential for inadvertent damage to this expensive component. This method also suggests precautionary methods such as paint masks, safety goggles, and gloves prior to servicing a filter due to the potential for exposure to the hazardous ash particles.

To avoid this dangerous mess, specialized filter cleaning equipment has been developed. There are two primary types of cleaning machines. The first type is a pulsed air cleaner. The pulsed air cleaner blasts a pressurized charge of air through the filter from the back-side and accumulates the ash in a large filter within the machine. The pulsed air cleaner operates within a 20 minute cycle and is used for most dirty filters. However, in some conditions the truck aftertreatment system does not properly initiate a regeneration cycle to burn the soot burning cycle, and the filters become plugged with sticky soot. It is impossible to blow out the soot plugged filters with the conventional pulsed air cleaner.

The second type of cleaning machine is a thermal regenerator. The soot plugged filter is heated in a thermal regenerator for a period of time to convert the soot to ash. The filter is then removed from the thermal regenerator and subsequently treated with a pulsed air cleaning machine to clean the filter. The thermal regenerator requires from 3 to 7 hours.

This equipment, however, is expensive to purchase for the service shop, which would make the cost of cleaning expensive for the motor vehicle owner. The machines take up a large amount of space in a typical shop. Both types of machines require compressed air sources, 110V electrical sources, and the thermal regenerator requires a 30 A 240V circuit as well.

Therefore, it would be advantageous to develop a method to quickly and easily clean the diesel particulate material from the filter, such as the ash particles and possibly the soot, especially without first baking the filter in a thermal regenerator. It would be further advantageous to clean the filter without using costly equipment or to develop a method using parts that are readily available in a service shop. It would also be advantageous to develop an apparatus that is easy to use and economical.

SUMMARY OF THE INVENTION

According to the invention there is provided an economical way of cleaning the ash and other diesel particulate material from a diesel particulate filter of a motor vehicle, typically using equipment already available in a service shop or economical to order. The method uses an air chamber connected at an open first end to an outlet of the diesel particulate filter. The air chamber has an opposite closed second end where a hanger is located. The air chamber has first and second ports in a sidewall between the first and second ends. A pressure relief valve couples to the first port which can be used to prevent the build up of dangerous pressure within the air chamber.

Air flows from an air supply into an air supply line to pressurize the air chamber. The air pressure can be regulated within the air chamber, such as with an air chamber regulator.

A vibrator coupled to the air chamber vibrates the air chamber. The pressurized air and the vibrations dislodge diesel particulate material from the diesel particulate filter, which can be removed from the filter.

A diesel particulate filter cleaning apparatus of the invention has an air chamber with an open first end, an opposite closed second end and a sidewall therebetween. First and second ports are located in the sidewall. An air chamber hanger is located at the second end. A pressure relief valve coupled to the first port can be used.

A vibrator is coupled to the sidewall of the air chamber to introduce vibrations to the diesel particulate filter cleaning apparatus. An isolator engages the air chamber hanger. An air chamber line couples to the second port of the air chamber and has an air chamber regulator to regulate the air pressure in the air chamber.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

The FIGURE is a side view of a diesel particulate filter cleaning apparatus of the invention with the ends of the diesel particulate filter and the air chamber in phantom.

DETAILED DESCRIPTION OF THE INVENTION

Turning to the FIGURE where like reference numerals refer to like structures, the present invention relates to a diesel particulate filter cleaning apparatus 10 and method for cleaning diesel particulate material such as ash and soot from a diesel particulate filter 42 used to treat diesel exhaust gases from a diesel engine in a motor vehicle. The diesel particulate filter cleaning apparatus 10 has a vibrator 14 coupled to an air chamber 12 with a vibrator coupler 56, such as a U-bolt coupled to a sidewall 32 of the air chamber 12.

The vibrator 14 is preferably a pneumatic or air actuated vibrator 15 with pressure regulators to increase intensity and frequency of vibration when the pressure increases within the vibrator. Alternatively, the vibrator 14 can be an electric or other type of pulse vibrator. When an pneumatic type vibrator is used, the vibrator 15 is in fluid communication with a vibrator line 34. The vibrator line 34 can have a vibrator regulator 36 to control the air pressure in the vibrator 15, and vibrator tubing 35 connecting to the vibrator pressure regulator 36 and the vibrator 15.

An open first end 22 of the air chamber 12 attaches to the diesel particulate filter 42 with a diesel particulate filter coupler 16. An opposite, closed second end 23 of the air chamber 12 has an air chamber hanger 24, such as a loop, handle, hook, clip, and the like. The sidewall 32 located between the first and second ends 22, 23 defines a chamber of the air chamber 12 and is preferably cylindrical. The air chamber 12 has a first port 60 in the sidewall 32 to which a pressure relief valve 18 attaches. The pressure relief valve 18 vents air from the air chamber 12 when the air pressure reaches a maximum pressure set with the pressure relieve valve 18. A second port 62 in the sidewall 32 connects to an air chamber line 19. The air chamber line 19 has an air chamber regulator 20 to regulate the air pressure in the air chamber 12 and air chamber tubing 21 connecting to the second port 62.

An air supply 26, such as from a shop air supply or an air tank, is in fluid communication with the air chamber 12 and the vibrator 15. An air supply line 28 from the air supply 26 connects to a fitting 30, such as a T-fitting when using the pneumatic vibrator 15. The fitting 30 connects to the vibrator line 34, such as at the vibrator regulator 36 and the air chamber line 19, such as at the air chamber regulator 20. Alternatively, the air supply line 28 can connect directly to air chamber line 19 or the air chamber regulator 20 when not using a pneumatic vibrator.

An isolator 38 isolates the fitting 30, the air chamber regulator 20 and vibrator regulator 36 from the vibrations generated by the vibrator 14. The fitting 30 and/or the pressure regulators can fasten to the isolator 38 with isolator fasteners 57, such as clips 58, loops, bands, and the like. The isolator 38 can be a strap made of vibration dampening material, such as a flexible polymer, for example nylon, rubber, and the like. The isolator 38 can be also used to hang the diesel particulate filter cleaning apparatus 10 from an overhead attachment 40. An isolator hanger 41, such as a hook, clip, loop, and the like, attaches to the isolator 38 and engages the air chamber hanger 24.

The diesel particulate filter coupler 16 connects an outlet 44 of the diesel particulate filter 42 to the air chamber 12. The diesel particulate filter coupler 16 has at least one flange and preferably uses a seal engaging the flange. The diesel particulate filter coupler 16 preferably uses an adaptor flange 48 engaging the air chamber 12, a diesel particulate filter flange 50 engaging the outlet 44 and a seal 52, such as a gasket, washer, O-ring, and the like, between the adaptor flange 48 and the diesel particulate filter flange 50. Diesel particulate filter coupler fasteners 64 fasten the adaptor flange 48 and diesel particulate filter flange 50 together.

The inlet 46 of the diesel particulate filter 42 connects to an ash collector 54, such as a shop-vac bag or other dust reservoir that allows clean air to vent from the ash collector 54 and the diesel particulate filter cleaning apparatus 10. The inlet 46 is preferably at least partially enclosed within ash collector 54 to prevent diesel particulate material from escaping into the environment during cleaning.

Once the apparatus is assembled, the air supply 26 is opened and air flows into the air supply line 28. Air next flows from the air supply line 28 into the air chamber 12. In one embodiment, the air flows through the fitting 30 and is directed into the air chamber line 19 and the vibrator line 34. The air chamber 12 and vibrator 15 pressurize. In another embodiment, the air flows only into the air chamber line 19 to pressurize the air chamber 12.

The air chamber regulator 20 can be set to a desired air chamber pressure to regulate the flow of air into the air chamber 12. The pressure in the air chamber 12 can range from about 10 psi to about 90 psi for the air chamber 12, although a maximum pressure is the amount of pressure that can be used without degrading the diesel particulate filter 42, such as about 120 psi. The pressure relief valve 18 is set to a maximum air chamber pressure in the air chamber 12, such as greater than about 120 psi. Once the maximum air chamber pressure is reached for the air chamber 12, the pressure relief valve 18 vents air from the air chamber 12.

The vibrator regulator 36 can be set to a desired vibrator pressure to regulate the flow of air into the vibrator 15. The pressure in the vibrator 15 can range from about 10 psi to about 60 psi, although about 90 psi may be the maximum pressure to produce the maximum vibrations without damaging the diesel particulate filter cleaning apparatus 10 and diesel particulate filter 42.

The vibrator 14 vibrates the air chamber 12. Vibrations transfer from the air chamber 12 to the diesel particulate filter 42 and air flows from the air chamber 12 through the diesel particulate filter 42 and through the ash collector 54. The vibrations and air loosen the diesel particulate material from the diesel particulate filter 42. The flowing air and gravity help remove the diesel particulate material from the diesel particulate filter 42 and into the ash collector 54. If a shop vacuum is used, it could be turned on to increase the removal of diesel particulate material from the diesel particulate filter apparatus 10.

Once air flows freely through the diesel particulate filter, the diesel particulate filter can be reinstalled on the vehicle. The vibrator 14 is turned off, such as by closing the air supply 26. Closing the air supply 26 also stops air from flowing to the air chamber 12. The diesel particulate filter 42 is disconnected from the ash collector 54 and the air chamber 12.

While the invention can be readily assembled from parts available in a shop, the invention can also include a kit of parts used to assemble a diesel particulate filter cleaning apparatus. The kit of parts includes the air chamber 12 with the first port 60 adapted to engage a pressure relief valve 18. A vibrator coupler 56 is adapted to engage a vibrator 14 and the sidewall 32 of the air chamber 12. At least one flange is adapted to engage the first end 22 of the air chamber 12 or an outlet 44 of the diesel particulate filter 42. An air chamber regulator 20 is adapted to regulate the air pressure entering the air chamber.

The method and apparatus of the invention have a number of advantages. The pressure within the air chamber of the diesel particulate filter cleaning apparatus is adjustable. The amount of vibration is also adjustable and can be independently adjusted. from the pressure within the air chamber. The pressure relief valve provides a safety measure to prevent dangerous pressure from building up within the diesel particulate filter cleaning apparatus. The diesel particulate filter cleaning apparatus of the invention is a small unit that hangs from an overhead attachment and performs the pulsed air cleaning function in a significantly faster time than the prior cleaning devices for thousands of dollars less. Further, in some instances the diesel particulate filter cleaning apparatus of the invention can open up a clogged diesel particulate filter which would normally require baking, to the extent that the filter can be reinstalled into a functioning aftertreatment system and regenerated by the on-board truck components.

While the invention is shown in only one of its forms, it is not thus limited but is susceptible to various changes and modifications without departing from the spirit and scope of the invention.

What is claimed is:

1. A diesel particulate filter cleaning apparatus for cleaning a diesel particulate filter, comprising:

an air chamber having an open first end, an opposite closed second end, a sidewall between the first and second ends, first and second ports in the sidewall, and an air chamber hanger at the second end;

a pressure relief valve being coupled to the first port;

a vibrator being coupled to the sidewall of the air chamber;

an isolator engaging the air chamber hanger; and an air chamber line being coupled to the second port of the air chamber and having an air chamber regulator.

2. A diesel particulate filter cleaning apparatus for cleaning a diesel particulate filter of claim 1, further comprising:

a vibrator line being in fluid communication with the vibrator and having a vibrator regulator.

3. A diesel particulate filter cleaning apparatus, comprising:

an air chamber having an open first end, an opposite closed second end, a sidewall between the first and second ends, first and second ports in the sidewall, and an air chamber hanger at the second end;

a pressure relief valve coupled to the first port;

a vibrator coupled to the sidewall of the air chamber;

an isolator engaging the air chamber hanger;

an air chamber line in fluid communication with the air chamber; and a diesel particulate filter having an inlet and an opposite outlet being connected to the first end of the air chamber.

4. A diesel particulate filter cleaning apparatus of claim 3, further comprising:

an air supply in fluid communication with the air chamber line; and an air chamber regulator in the air chamber line.

5. A diesel particulate filter cleaning apparatus of claim 4, further comprising:

a vibrator line being in fluid communication with the vibrator and the air supply and having a vibrator regulator.

6. A diesel particulate filter cleaning apparatus of claim 5, wherein the air chamber and the diesel particulate filter are connected with flanges and a seal between the flanges.

7. A kit of parts capable of being assembled into a diesel particulate filter cleaning apparatus for cleaning a diesel particulate filter, comprising:

a pressure relief valve;

an air chamber having an open first end, an opposite closed second end, a sidewall between the first and second ends, a first port in the sidewall adapted to engage the pressure relief valve, a second port in the sidewall, and a hanger at the second end;

a vibrator;

a vibrator coupler adapted to engage the vibrator and the sidewall of the air chamber;

an air chamber regulator adapted to control the pressure in the air chamber; and an isolator adapted to engage the air chamber hanger.

8. A kit of parts capable of being assembled into a diesel particulate filter cleaning apparatus for cleaning a diesel particulate filter of claim 7, further comprising:

a vibrator regulator adapted to control the pressure in the vibrator.

9. A kit of parts capable of being assembled into a diesel particulate filter cleaning apparatus for cleaning a diesel particulate filter of claim 8, further comprising:

a diesel particulate filter coupler adapted to connect the first end of the air chamber to an outlet of the diesel particulate filter.

10. A kit of parts capable of being assembled into a diesel particulate filter cleaning apparatus for cleaning a diesel particulate filter of claim 8, further comprising:

a diesel particulate filter coupler adapted to connect the first end of the air chamber to an outlet of the diesel particulate filter and having at least one flange, and a seal adapted to engage the flange.

11. A kit of parts capable of being assembled into a diesel particulate filter cleaning apparatus for cleaning a diesel particulate filter of claim 8, further comprising:

an adaptor flange adapted to engage the first end of the air chamber;

a diesel particulate filter flange adapted to engage an outlet of the diesel particulate filter;

a seal adapted to fit between the adaptor flange and the diesel particulate filter flange; and fasteners for fastening the adaptor flange and the diesel particulate filter flanges.

* * * * *